United States Patent [19]

Goudy, Jr. et al.

[11] Patent Number: 4,869,852

[45] Date of Patent: Sep. 26, 1989

[54] DIFFUSER APPARATUS

[75] Inventors: Paul R. Goudy, Jr., Bayside; Douglas F. Mooers, Milwaukee; Bruce C. Mundt, Theinsville; Thomas E. Jenkins, Glendale, all of Wis.

[73] Assignee: Mooers Products, Inc., Milwaukee, Wis.

[21] Appl. No.: 147,156

[22] Filed: Jan. 22, 1988

[51] Int. Cl.[4] ..... B01F 3/04

[52] U.S. Cl. ..... 261/122

[58] Field of Search ..... 261/122

[56] References Cited

U.S. PATENT DOCUMENTS

| | | | |
|---|---|---|---|
| 153,453 | 2/1874 | Miller | 261/122 |
| 615,093 | 11/1898 | McIntyre | 261/122 |
| 654,378 | 7/1900 | Barckdall | 261/122 |
| 664,457 | 12/1900 | Bennett | 261/122 |
| 671,042 | 4/1901 | Barckdall et al. | 261/122 |
| 1,552,866 | 9/1925 | Miller | 261/122 |
| 1,605,251 | 11/1926 | MacMillan et al. | 261/122 |
| 1,982,305 | 11/1934 | Hunicke | 261/122 |
| 2,223,348 | 12/1940 | Boedeker et al. | 261/122 |
| 2,468,934 | 5/1949 | Kleyn | 261/122 |
| 3,334,819 | 8/1967 | Olavson | 239/533.13 |
| 3,525,436 | 8/1970 | Reckers | 210/220 |
| 3,575,350 | 4/1971 | Willinger | 239/145 |
| 3,642,260 | 2/1972 | Danjes et al. | 261/122 |
| 3,682,314 | 8/1972 | Blatter | 261/122 |
| 3,892,519 | 7/1975 | Reed et al. | 261/122 |
| 3,997,634 | 12/1976 | Downs | 261/122 |
| 4,540,162 | 9/1985 | Gozlan | 261/122 |
| 4,597,530 | 7/1986 | Goudy, Jr. et al. | 239/452 |
| 4,629,126 | 12/1986 | Goudy, Jr. et al. | 239/452 |

FOREIGN PATENT DOCUMENTS

| | | | |
|---|---|---|---|
| 2710073 | 6/1978 | Fed. Rep. of Germany | 261/122 |
| 712817 | 8/1954 | United Kingdom | 261/122 |

OTHER PUBLICATIONS

Pollution Control, Inc. Bulletin 2000, "PCI Hydro--Chek Air Diffusers", 1982.

Chicago Pump Bulletin 7822-A, 1967, Chicago, Ill. 60614.

Chicago Pump Bulletin 7823, 1969, Chicago, Ill. 60614.

*Primary Examiner*—Tim Miles

*Attorney, Agent, or Firm*—Quarles & Brady

[57] ABSTRACT

A diffuser assembly for diffusing air into wastewater includes a plurality of diffuser elements arrayed along the bottom of a container for the wastewater. Each diffuser element has an inlet connected to a source of air under pressure and an outlet for discharging air in the form of discrete bubbles. A perforate sheet is spaced above each of the diffuser elements to capture bubbles which will tend to agglomerate by the time they reach the level of the sheet. The sheet has a plurality of polygonal openings which reform the trapped gas into discrete bubbles as the gas passes through the sheet. Additional levels of perforate sheets may be spaced above the first perforate sheet. The perforate sheets may be in the form of individual sheets each attached to a respective diffuser element, or the sheets may be part of a continuous sheet or sheets suspended across the container for the wastewater.

15 Claims, 4 Drawing Sheets

DIFFUSER APPARATUS

BACKGROUND OF THE INVENTION

This invention relates to the diffusing of one fluid within another, and particularly to a diffuser apparatus that repeatedly forms and reforms globules or bubbles of the one fluid for dispersal in a pool of the other fluid.

Fluid diffusers are commonly employed to aerate wastewater as part of the biological treatment of the wastewater. The diffusers are submerged in the wastewater and discharge bubbles of air that ascend through the wastewater. This results in a transfer of oxygen between the bubbles of air and the wastewater. The oxygen is used for respiration by organisms that feed on the impurities in the wastewater and thereby remove the impurities.

One common form of fluid diffuser discharges the air through one or more outlets in a circular array to more widely disperse the bubbles of air. Examples of this form of diffuser are found in the following U.S. Pat. Nos.: 3,334,819 issued Aug. 8, 1967 to Olavson; 3,525,436 issued Aug. 25, 1970 to Reckers; 3,997,634 issued Dec. 14, 1976 to Downs; 4,597,530 issued Jul. 1, 1986 to Goudy, Jr. et al.; and 4,629,126 issued Dec. 16, 1986 to Goudy, Jr. et al..

Other forms of fluid diffusers use porous stones, either natural or man-made, slit tubes, porous fabric socks, and perforated plates, all for the purpose of changing the entering stream of air into bubbles.

The oxygen transfer between the bubbles and the surrounding wastewater takes place at the surface of the bubbles. Therefore, it is important to maximize the surface areas of the bubbles to the greatest extent possible to thereby maximize the oxygen transfer. Generally, the surface area of the bubbles is maximized by forming many fine bubbles. However, as the bubbles rise within the pool of wastewater, they tend to combine or agglomerate into larger bubbles with the result that the total surface area is reduced. This negatively impacts on the rate of oxygen transfer.

The present invention provides apparatus and method for maximizing the surface area of the air bubbles as they pass through the wastewater. The surface area is maximized by collecting the bubbles after they agglomerate and then reforming them as smaller discrete bubbles. This is accomplished as the air moves from the depths of the pool of wastewater to the surface thereof.

Although the invention has particular application to fluid diffusers for aerating wastewater, it is applicable to the dispersal of any one fluid, either gas or liquid, into a pool of a second fluid.

SUMMARY OF THE INVENTION

The invention resides in a diffuser assembly for diffusing a first fluid within a pool of a second fluid. The assembly includes a diffuser element for submergence in the pool of the second fluid and an inlet for connection to a source of the first fluid and an outlet for discharging globules of the first fluid into the second fluid, together with a perforate sheet spaced from the diffuser element in the direction of travel of the globules and having multiple openings through which agglomerated globules trapped against the sheet can pass and be reformed as discrete globules.

The first fluid may be a liquid which is to be dispersed in another liquid, and in such case the globules will be in the form of droplets of the liquid. Alternately, the first fluid may be a gas for dispersal in a liquid, in which case the globules will be in the form of bubbles of the gas.

The invention further resides in a method for diffusing one fluid, such as a gas, into a second fluid, such as a liquid, and in which the gas is discharged into a pool of the liquid in the form of discrete bubbles, the gas is collected after the bubbles have passed through a first depth of the fluid and have begun to agglomerate, and the collected gas is reformed as discrete bubbles for discharge into the fluid above the first depth.

In the preferred embodiment of the apparatus, a plurality of diffuser elements are arrayed adjacent the bottom of a container for the pool of fluid. The diffuser elements each have a perforate sheet spaced above the outlet of the diffuser element and attached to either the diffuser element, to the container, or some other structure within the container. As fluid such as gas is discharged through the outlets of the diffuser elements, the globules in the form of bubbles will rise within the pool of fluid. As they rise, they will tend to agglomerate and the agglomerated bubbles are trapped or collected on the underside of the perforate sheets. The perforate sheets have openings through which the collected gas can pass and in so doing be reformed as bubbles as the gas continues its passage through the pool.

The openings in the perforate sheets are preferably polygonal in shape.

When the common form of diffuser element is used in which the gas bubbles are discharged in a circular array, the perforate sheet can likewise be circular and be connected at its perimeter to the diffuser element by flexible straps. The spacing between the sheet and the diffuser element can be maintained by the buoyant force created by the trapped gas beneath the sheet.

The perforate sheets can also be a part of a large sheet that is suspended within the container for the pool and spaced above many diffuser elements at the bottom of the container.

Whether individual perforate sheets are provided for each diffuser element, or the perforate sheets are part of a large sheet overlying many diffuser elements, the apparatus can include multiple layers of such sheets each spaced from its adjacent sheet so that the discharged fluid is constantly collected and reformed into discrete globules.

It is a principal object of the invention to provide a method and an apparatus for dispersing one fluid within a second fluid and in which the first fluid is repeatedly formed into discrete globules such as bubbles as the fluid passes through the second fluid.

It is another object of the invention to increase the mass transfer between one fluid and a second fluid through which it is dispersed by maximizing the surface area of the first fluid as it passes through the second fluid.

It is a further object of the invention to provide sites to deform or form discrete globules and, in so doing, to minimize the surface tension and increase the mass transfer.

The foregoing and other objects and advantages of the invention will appear from the following detailed description. In the detailed description, reference is made to the accompanying drawings which illustrate preferred embodiments of the invention.

DETAILED DESCRIPTION OF THE DRAWINGS

Figure 1:
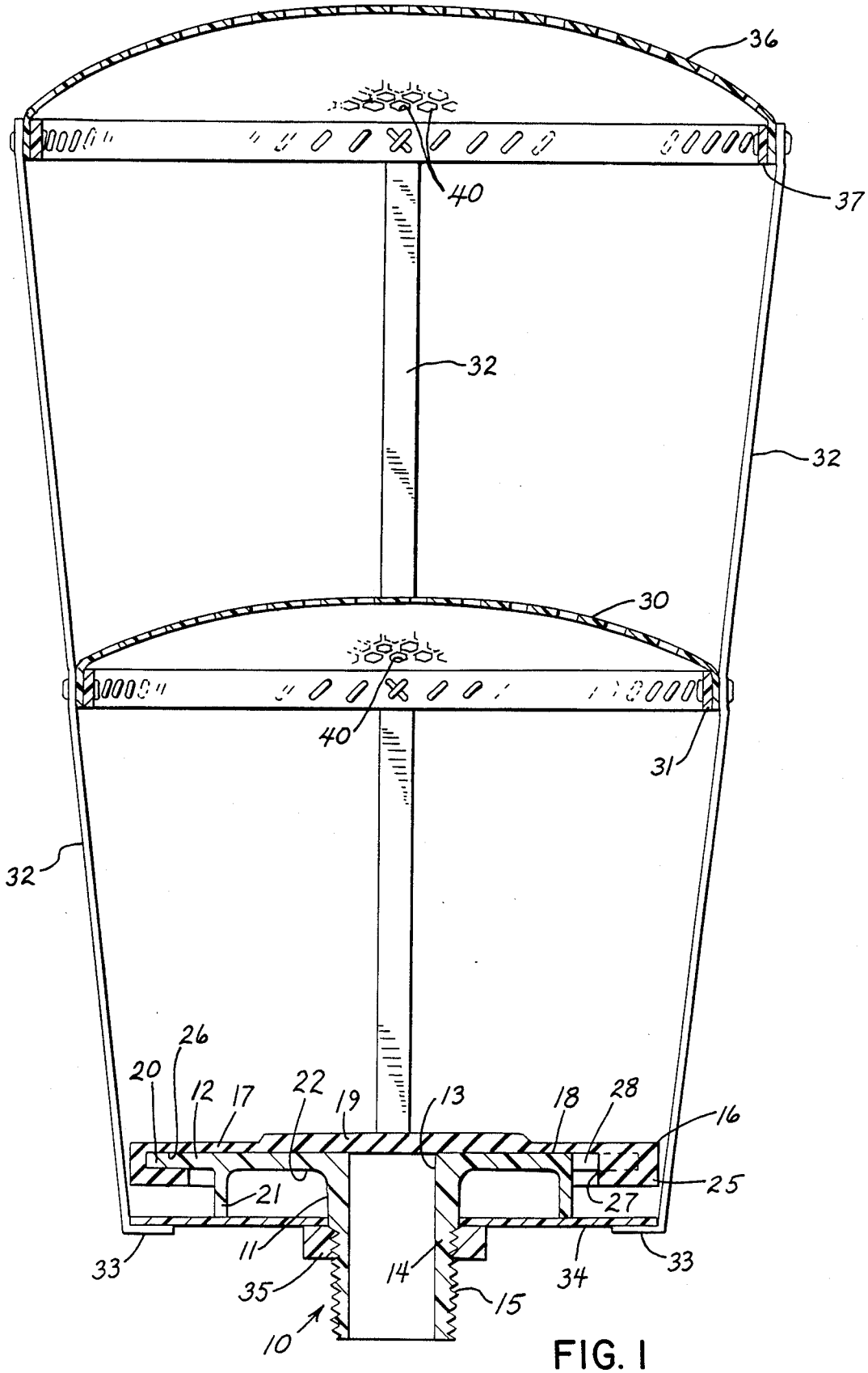
FIG. 1 is a view in vertical section taken through the center of a diffuser in accordance with the present invention.

Referring to FIG. 1, a diffuser apparatus is shown with a diffuser element 10 of the type illustrated and described in U.S. Pat. No. 4,629,126. Generally, the diffuser element includes a rigid body 11 that has a flat disc 12 with a central opening 13 and an integral, hollow boss 14 which has standard external pipe threads 15. A flexible rubber diaphragm 16 has a flat upper portion 17 that overlays the top face 18 of the disc 12. The flat portion 17 of the diaphragm has a built up center portion 19 that acts as a check valve to close off the central opening 13 under the pressure of fluid above the diffuser element.

The outer perimeter of the disc 11 has a plurality of spaced radially extending fingers 20 that are formed integral with the disc. A depending circular cylindrical wall 21 extends from the bottom face 22 of the disc 11 at the radially inner bases of the fingers 20.

The diaphragm 16 has a thick rim portion 25 with a series of radial recesses 26 that receive and complement the outer ends of the fingers 20. The rim portion 25 has an inwardly facing inner edge 27 that is spaced from the wall 21. The bases of the fingers 20 are thereby left free so that air openings or outlets 28 are defined at the bottom of the spaces between adjacent fingers 20.

When a fluid under pressure, such as air, is admitted into the central opening 13, the flat upper portion 17 of the diaphragm 16 will tend to lift off of the top face 18 of the disc 12 and the air can then escape radially between the disc 12 and diaphragm 16 and out of the openings 28. If the diffuser element 10 is submerged in a pool of another fluid, such as wastewater, the air exiting the openings 28 will be in the form of dispersed bubbles which will tend to rise through the wastewater. What has been described thus far is known from the prior art including the aforementioned U.S. Pat. No. 4,629,126.

In accordance with the present invention, one or more perforate sheets are mounted in spaced relationship from the diffuser element 10 and from each other. In the embodiment of FIG. 1, a first sheet 30 is formed in a circle and has its perimeter attached to an open circular hoop 31. The hoop is attached in turn to a plurality of straps 32 which extend upwardly from the diffuser element 10. Specifically, the bottom ends 33 of the straps 32 are attached adjacent the perimeter of a circular plate 34 that is held against the bottom of the depending wall 21 by a nut 35 threaded on the threads 15 of the boss 14. A second circular perforate sheet 36 likewise has its perimeter attached to an open, rigid hoop 37 which in turn is connected to the top ends of the straps 32.

Figure 3:
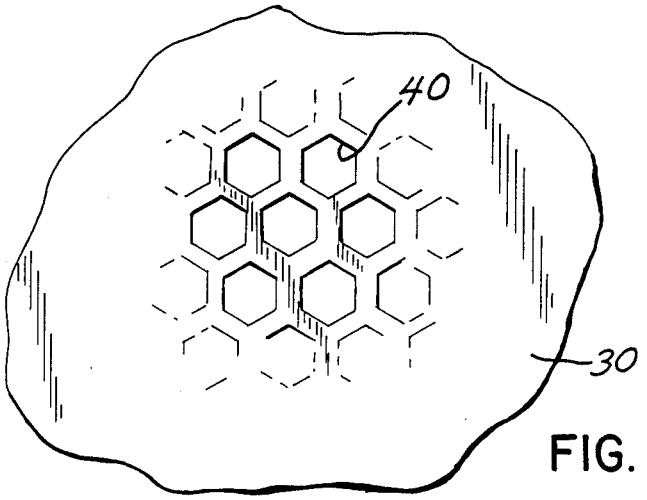
FIG. 3 is a partial plan view of a perforate sheet used in the diffusers of FIGS. 1 and 2.

As shown particularly in FIG. 3, the perforate sheets 30 and 36 contain a plurality of spaced openings 40. The preferred shape of the openings 40 is that of a polygon, rather than an opening with a smooth perimeter such as a circle or an oval. However, any shaped opening will work, including slits in a sheet.

When air under pressure is admitted through the diffuser element 10 and discharged therefrom through the outlets 28, the bubbles of air will begin to join together, or agglomerate, into larger bubbles as they pass upwardly through the wastewater or other fluid. The agglomerating bubbles will soon encounter the underside of the first perforate sheet 30. The air bubbles collected on the underside of the sheet 30 will form a large bubble which will be trapped beneath the sheet 30 until the pressure of the built up air is sufficient to overcome the surface tension of the large bubble. At that time, the air will pass through the openings 40 in the first sheet 30 and be reformed in so doing as small discrete bubbles. The action is repeated as the bubbles pass through the layer of water from the first sheet 30 to the second sheet 36. Agglomerating bubbles will again be trapped and collected and reformed once again as small discrete bubbles as they pass through the openings 40 in the second sheet 36.

The perforate sheets 30 and 36 are preferably of a very flexible material which is loosely stretched across the opening in the hoops 31 and 37, respectively. The domed shape assumed by the sheets 30 and 36 in FIG. 1 would be that resulting from the ballooning of the sheets by the buoyant force of air trapped beneath the sheets. The domed shape of the sheets 30 and 36 in FIG. 1 could also be preformed into the sheets.

The perforate sheets 30 and 36 can be formed of any perforated material, including a woven fabric or a flexible or rigid plastic film. The hoops 31 and 37, the straps 32, the circular plate 34, the base 11, and the nut 35 can all be formed of synthethic resin material. The lower ends of the straps 32 can be adhesively secured to the plate 34 or can be attached thereto by sonic or solvent welding. The hoops, sheets and straps may be joined to each other by stitching, as shown in FIG. 1, although any other form of attachment can be used. The straps 32 may be stiff. However, in a diffuser apparatus that is to be used to diffuse a gas in a liquid, the straps 32 preferably are flexible ribbons so that the hoops 37 and 31 can be collapsed down upon the diffuser element 10 for shipment and storage. The proper spatial relationship between the first sheet 30 and the diffuser element 10 and between the second sheet 36 and the first sheet 30 will be maintained when the buoyant force of the gas lifts the sheets away from the diffuser element and from each other.

Figure 2:
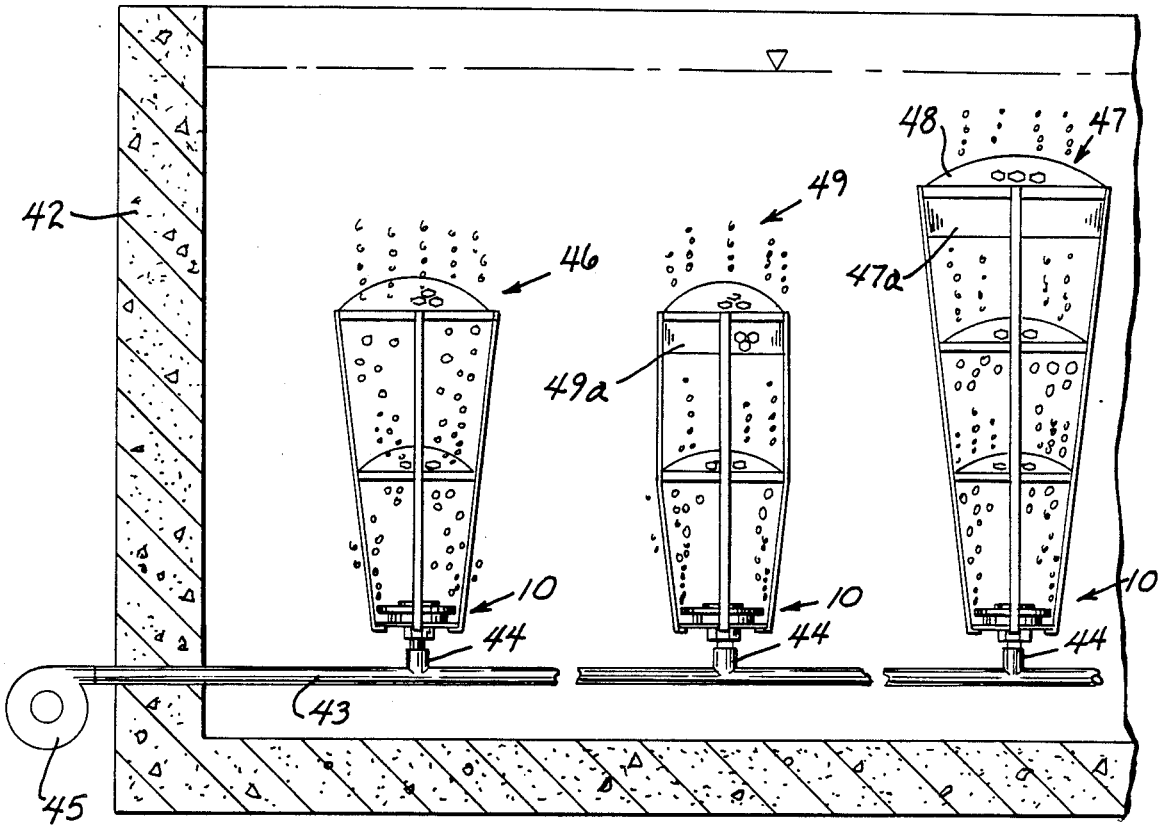
FIG. 2 is a view in elevation and partially in section through an installation utilizing several forms of diffusers in accordance with the present invention, including the diffuser of FIG. 1.

FIG. 2 shows an assembly which utilizes a plurality of the diffusers of FIG. 1. In FIG. 2, a variety of different diffuser assemblies are shown mounted within a concrete tank 42. The tank 42 has a lower air delivery pipe 43 having a plurality of upright nipples 44 into which are screwed the threaded bottoms of the diffuser elements 10. The delivery pipe 43 is connected to a source of air under pressure such as the blower 45. The first diffuser indicated generally by the numeral 46 is identical to that illustrated and described in FIG. 1. The third diffuser 47 is similar to the first diffuser 46 except it has a third level of perforate sheet 48. It will be noted that in each of the diffusers 46 and 47 that the diameter of the perimeter of each perforate sheet is greater than the diameter of the circular pattern of bubbles released from the diffuser element 10 and is greater than the diameter of the preceding sheet. This will insure that the majority of the bubbles released from a lower level, and particularly from the diffuser element, will be captured at the next level.

In the second diffuser 49 of FIG. 2, there are two levels of perforate sheets and the second level has a diameter equal to that of the first level. Since the bubbles released from a perforate sheet will be released across its entire surface area, rather than only about a circular perimeter of the diffuser element, there is less need for spreading the capture area beyond the first level of perforate sheet.

The second and third diffusers 49 and 47 of FIG. 2 illustrate a further modification that can be made by adding skirts that extend downwardly from the perimeter of the perforate sheets to expand the volume of gas that will be trapped or collected beneath a perforate sheet. The second diffuser 49 has a circular cylindrical skirt 49*a* that may also have openings similar to the openings in the perforate sheet. Alternatively, the skirt may be imperforate, such as shown by the circular conical skirt 47*a*. In either case, the skirt will accumulate a larger volume of gas than would a ballooning perforate sheet by itself. This larger volume of gas will increase the pressure head and assist in forcing the gas through the perforate sheet. The skirt is particularly useful at the higher levels in the pool where the quantity of gas available to be collected will be less than at lower levels.

The skirts may be formed as separate elements. The skirts may also be extensions of the perforate sheets or may be extensions of the hoops.

Figure 4:
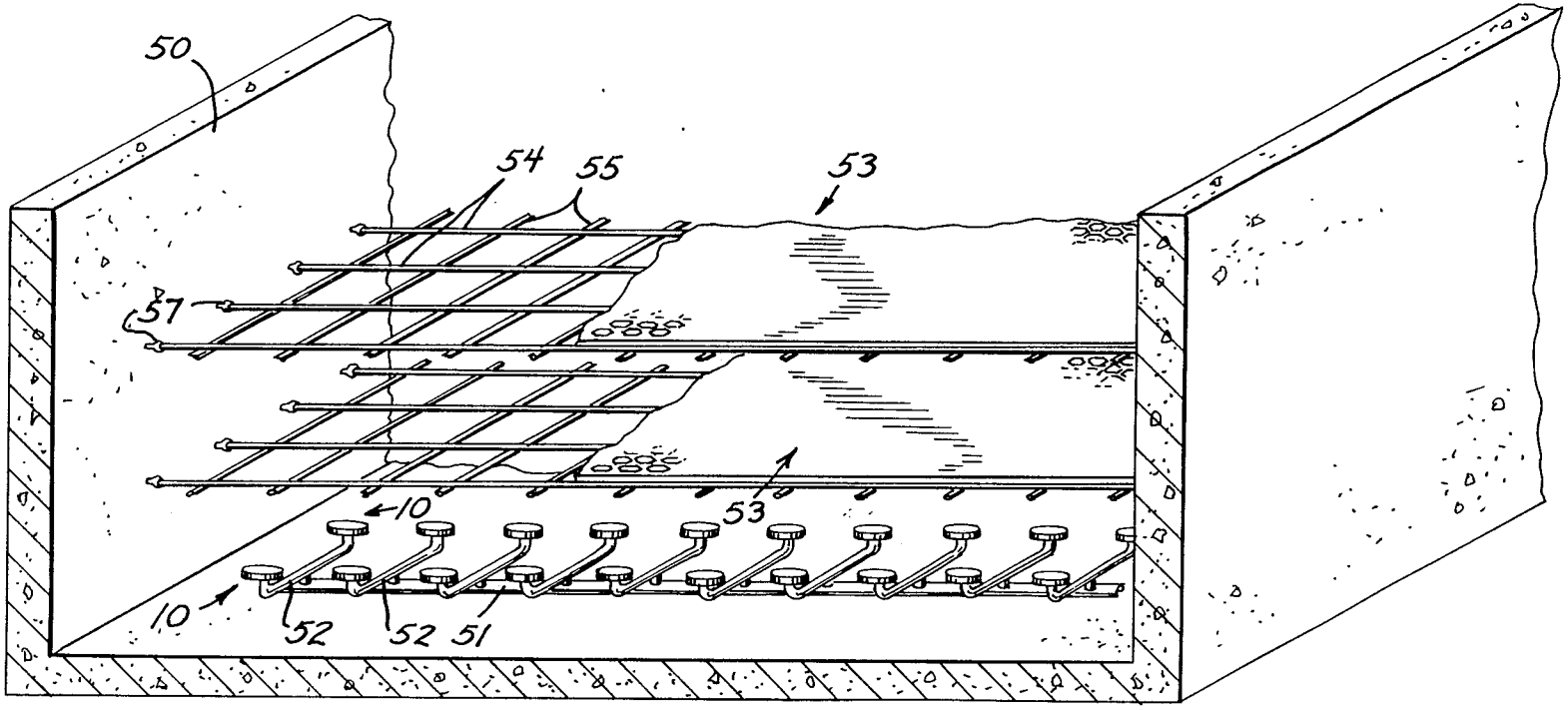
FIG. 4 is a view in perspective and partially in section of an assembly utilizing a plurality of diffuser elements and continuous perforate sheets.
Figure 5:
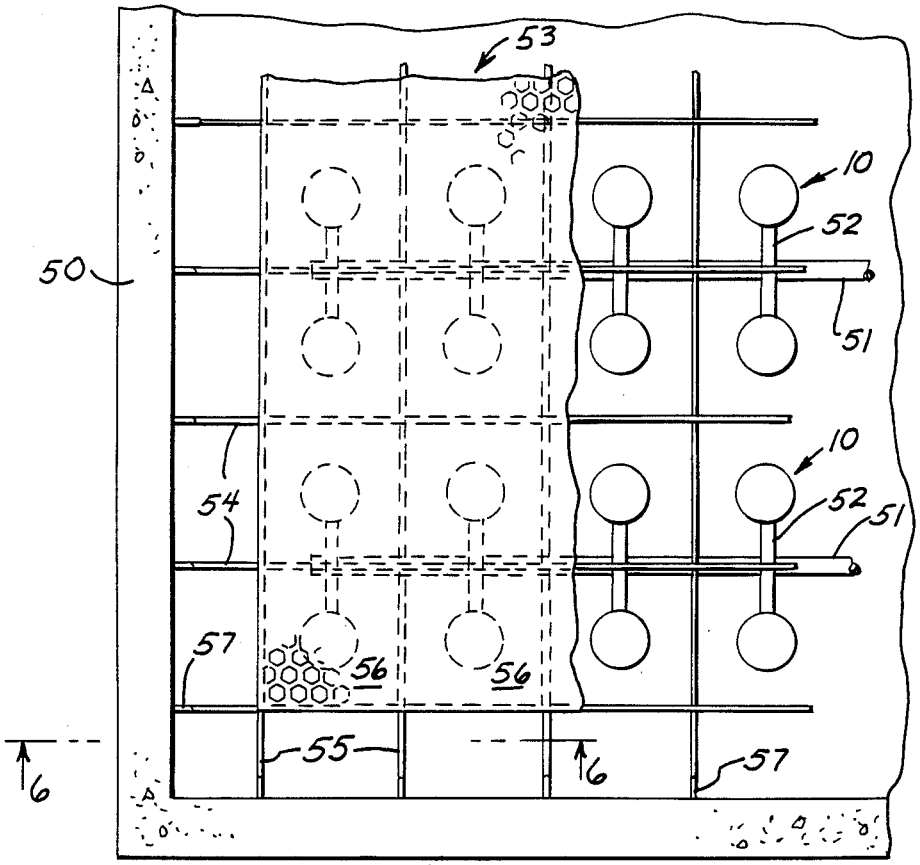
FIG. 5 is a plan view of a portion of the installation of FIG. 4 with portions broken away for purposes of illustration.
Figure 6:
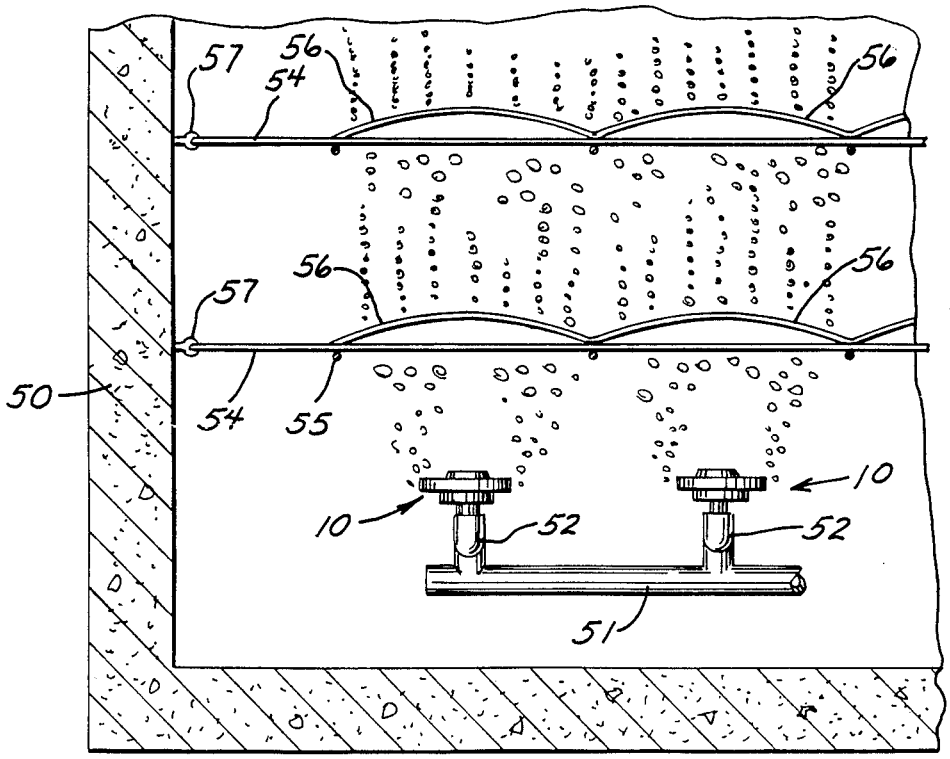
FIG. 6 is a view in elevation taken in the plane of the line 6—6 of FIG. 5.

FIGS. 4, 5 and 6 disclose another embodiment of the invention in which the perforate sheets are part of large, continuous sheets mounted in a container for the fluid and with a plurality of diffuser elements arrayed along the bottom of the container. Specifically, a concrete tank 50 has a series of air distribution pipes 51 each with a plurality of cross headers 52 that mount diffuser elements, such as the elements 10, on the ends of the cross headers. As shown in FIG. 5, the array is such that the plurality of diffuser elements 10 are equally spaced over the bottom of the tank 50. One or more perforate sheets indicated generally by the numeral 53 are suspended within the tank 50 and are spaced above the outlets of the diffuser elements 10. The sheets 53 include a multiplicity of cross support wires 54 and 55 which divide the sheet 53 into a grid of separate sheet portions 56. The sheet portions 56 constitute individual perforate sheets but may be formed from a large sheet attached to the cross wires 54 and 55. Each separate sheet 56 is positioned directly above a respective diffuser element 10. The cross wires 54 and 55 are attached to eye bolts 57 that project from the side walls of the tank 50.

While the embodiment of FIGS. 4–6 uses continuous sheets 53 that provide perforate portions above each diffuser element, the sheets 53 could have grid portions that do not include a perforate sheet portion 56. Such interruptions in the sheets may be used to control the mixing or flow of the liquid in the container 50. For example, the first level of sheets 53 could be open above one diffuser element and contain a perforate sheet portion 56 above an adjacent diffuser element, while the second level of sheets 53 could have the opposite arrangement of open end closed grid portions.

In all of the embodiments, the fluid such as gas that is discharged from the diffuser element will initially be discharged as discrete bubbles. As those bubbles rise within the fluid in the pool such as wastewater, the bubbles will tend to combine and agglomerate thereby reducing the surface area over which the mass transfer between the fluids can take place. However, the combining and agglomerating bubbles will be captured and then reformed as they pass through one or more of the perforate sheets. The reformed bubbles will be discharged through the sheet as smaller discrete bubbles thereby again increasing the surface area and enhancing the mass transfer.

The polygonal shape of the openings 40 in the perforate sheets has been found to be superior in performance to that of circular openings or other smooth profile openings. The irregular profile of the polygonal openings aids in overcoming the surface tension of the fluid by maximizing, as compared to a circle, the surface area of the fluid as it is extruded through the openings.

Although the invention finds particular use in the treatment of wastewaters where the diffusing fluid is air, it can be used to diffuse any fluid within another, including a liquid within a liquid. In the latter case, the diffusing liquid would be discharged from a diffuser element in the form of drops rather than bubbles and might either ascend or descend through the fluid into which the drops are discharged depending upon relative pressures and densities. However, by spacing a perforate sheet at a distance from the discharge outlet of the diffuser element, the droplets of liquid may also be captured and reformed as they tend to agglomerate.

Although the invention has been described in terms of employing diffuser elements that discharge the globules, whether droplets or bubbles, in a circular pattern, the invention can incorporate diffuser elements of any type which will discharge the fluid in the form of discrete globules. Thus, any of the known types of diffuser elements, such as slit tubes, porous stones, porous socks and perforated plates, can be used in the practice of the present invention.

We claim:

1. A diffuser assembly for diffusing a first fluid within a pool of a second fluid, comprising:

a diffuser element adapted to be submerged in the pool of the second fluid, the diffuser element having an inlet connectable to a source of the first fluid and an outlet for discharging globules of the first fluid into the second fluid; and a perforate flexible sheet spaced from the diffuser element in the direction of travel of the globules, said sheet adapted to balloon to trap agglomerated globules discharged from the diffuser element, said sheet having multiple openings through which the first fluid passes and is reformed as globules which are again discharged into the second fluid.

2. A diffuser assembly for diffusing a gas into a pool of a liquid, comprising:

a diffuser element adapted to be submerged in the pool of liquid, said element having an inlet connectable to a source of the gas under pressure and an outlet for discharging bubbles of the gas into the liquid; and a perforate flexible sheet spaced above the diffuser element and adapted to balloon under the pressure of gas under the sheet to collect agglomerated bubbles of the gas after they have passed through a depth of the liquid, said sheet having a plurality of open holes through which the gas passes as reformed discrete bubbles.

3. A diffuser assembly in accordance with claim 2 together with another like perforate sheet spaced above the first perforate sheet.

4. A diffuser assembly in accordance with claim 2 wherein the outlet of the diffuser element is arranged for discharge of the bubbles in a circular pattern and the sheet is circular and has a diameter greater than the diameter of the circular pattern of the discharged bubbles.

5. A diffuser assembly in accordance with claim 2 wherein the holes are polygonal.

6. A diffuser assembly for diffusing a gas into a pool of a liquid in a container, comprising:

a plurality of diffuser elements arrayed adjacent the bottom of the container, each diffuser element having an inlet connectable to a source of the gas under pressure and an outlet above the inlet and through which the gas is discharged as bubbles; and a perforate flexible sheet spaced above each diffuser element and supported solely by the diffuser element, said sheet adapted to balloon to collect agglomerated bubbles of the gas after they have passed from the diffuser element through a depth of the liquid, said sheet having a plurality of openings through which the gas will pass as reformed discrete bubbles.

7. A diffuser assembly in accordance with claim 6 together with a second larger perforate flexible sheet spaced from and overlaying the first sheet over each diffuser element, the second sheet being also supported solely by the diffuser element.

8. The diffuser assembly for diffusing a gas into a pool of a liquid, comprising:

a plurality of diffuser elements adapted to be arranged adjacent the bottom of the pool, each diffuser element having an inlet connectable to a source of the gas under pressure and an outlet through which the gas is discharged as bubbles; and a perforate, flexible sheet spaced above the diffuser elements and said sheet adapted to balloon in the area above each diffuser element to collect agglomerated bubbles of the gas after they have passed through a depth of the liquid, said sheet having a plurality of spaced open holes through which the gas will pass as reformed discrete bubbles.

9. A diffuser assembly in accordance with claim 8 wherein there are additional perforate, flexible sheets spaced above the first sheet and spaced from each other.

10. A diffuser assembly for diffusing a gas within a pool of a liquid, comprising:

a diffuser element adapted to be submerged in the pool of liquid, said element having an inlet and a circular array of outlets for discharging bubbles of the gas into the liquid;

a circular, perforate, flexible sheet having a perimeter whose diameter is greater than the diameter of the circular array of outlets, said sheet having a plurality of openings through which gas will pass as discrete bubbles; and straps joining the perimeter of the sheet to the diffuser element in spaced relation.

11. A diffuser assembly in accordance with claim 10 wherein the straps are flexible and the spacing of the sheet from the diffuser element is maintained by the buoyant force of agglomerated bubbles collected under the sheet which will balloon.

12. A diffuser assembly in accordance with claim 10 wherein the openings in the sheet are polygonal.

13. A diffuser assembly in accordance with claim 10 together with a second circular, perforate, flexible sheet joined at its perimeter to the perimeter of the first sheet by straps.

14. A diffuser assembly in accordance with claim 10 wherein the perimeter of the sheet is attached to a rigid circular hoop.

15. A diffuser assembly in accordance with claim 10 together with a skirt depending from the perimeter of the sheet.

* * * * *